US006093893A

United States Patent [19]

Fang-Crichton

[11] Patent Number: 6,093,893

[45] Date of Patent: Jul. 25, 2000

[54] RADIATION-HARDENED ELECTRICAL CABLE HAVING TRAPPED-ELECTRON REDUCERS

[75] Inventor: Su Fang-Crichton, Santa Cruz, Calif.

[73] Assignee: The United States of America as represented by the Secretary of the Navy, Washington, D.C.

[21] Appl. No.: 09/041,964

[22] Filed: Mar. 13, 1998

[51] Int. Cl.[7] ..... H01B 7/18

[52] U.S. Cl. ..... 174/102 R; 174/126.2

[58] Field of Search ..... 174/106 R, 113 R, 174/113 AS, 120 R, 126.2, 102 R

[56] References Cited

U.S. PATENT DOCUMENTS

| | | | |
|---|---|---|---|
| 3,676,566 | 7/1972 | McBride | 174/36 |
| 4,049,904 | 9/1977 | Hori et al. | 174/107 |
| 4,092,452 | 5/1978 | Hori et al. | 428/215 |
| 4,221,926 | 9/1980 | Schneider | 174/107 |
| 4,383,225 | 5/1983 | Mayer | 333/12 |
| 4,656,313 | 4/1987 | Moore et al. | 174/35 R |
| 4,675,471 | 6/1987 | Shida et al. | 174/36 |
| 4,769,515 | 9/1988 | Hubis et al. | 174/110 |
| 5,020,411 | 6/1991 | Rowan | 89/1.11 |
| 5,416,271 | 5/1995 | Birmingham | 174/65 R |

*Primary Examiner*—Dean A. Reichard
*Assistant Examiner*—William H Mayo, III
*Attorney, Agent, or Firm*—John Tarlano; Darrell Hollis

[57] ABSTRACT

A radiation-hardened cable which has a central conductor and a first trapped-electron reducer surrounding the central conductor. The first trapped electron reducer is an aluminum layer on a dielectric film whereby the aluminum layer is in electrical contact with the central conductor. A dielectric insulator surrounds the first trapped-electron reducer and a second trapped-electron reducer surrounds the dielectric insulator. The second trapped-electron reducer is an aluminum layer on a dielectric film which is in electrical contact with the dielectric insulator. A metal shield surrounds the second trapped-electron reducer and is in electrical contact with the aluminum layer of the second trapped-electron reducer.

20 Claims, 5 Drawing Sheets

RADIATION-HARDENED ELECTRICAL CABLE HAVING TRAPPED-ELECTRON REDUCERS

BACKGROUND OF THE INVENTION

A prior art electrical cable is composed of an inner silver-coated copper wire conductor, a central dielectric insulator layer, an outer silver-coated copper shield, and an external dielectric jacket. FIG. 1 shows a cross-section of a prior art cable.

When this prior art cable is exposed to transient X-rays and gamma-rays from a nuclear explosion, that is high energy photons, large numbers of free electrons will be produced by the inner conductors and outer shield of the prior art cable. Many of these free electrons make their way to many electron traps in the dielectric at both the conductor-insulator interface and at the shield-insulator interface. Most of these latter, previously free, electrons will be stored, that is trapped, in electron traps in the prior art cable.

Trapped electrons occur as a result of excess free electrons transferring from the metal, namely conductors and shield, to the dielectric layer, that is insulator. The presence of gaps and spaces between the metal and the dielectric layer then prevent these excess electrons in the dielectric layer from returning to the metal to recombine with positive ions, namely holes, and hence they are trapped in the dielectric layer.

The spatial distribution of trap-sites and the differential number of trapped negative charges, at or near the shield-dielectric interface versus the negative charges at or near the conductor-dielectric interface, induce an electric field, namely an electromotive force, that acts on other electrons in the inner conductors and the outer shield. A pulse of electrical current called Systems-Generated-Electromagnetic Pulse, or SGEMP, will automatically flow through any conductive path from the inner conductors to the shield, or from the shield to the inner conductor, to balance the surge of displaced charges and to eliminate the electric field. When such a cable interconnects electronic equipment, a transient SGEMP current pulse is said to flow through the circuits that are the conductive pathways inside the electronic equipment between the shield and the conductors. An SGEMP current pulse, of either positive or negative polarity, can damage sensitive electronic components along its path. Such a path is shown in FIG. 2.

When any electrical cable is exposed to X-rays or gamma-rays, all of the materials in the cable become ionized, creating electrons and positive ions, that is, holes. The electrons, being very small and mobile, scatter in all different directions but primarily away from the direction of the radiation source and backscatter toward the radiation source.

The atomic number (Z) of an atomic element indicates the number of electrons in electron shells of an non-ionized atom. Although all materials ionize under radiation, materials with higher atomic numbers have larger radiation cross-sections, that is larger radiation interactivity, which cause them to emit more electrons. Since electrical cables are essentially concentric layers of different atomic number elements, there is a net flow of electrons from the higher atomic number layers to lower atomic number layers, upon irradiation of the layers.

As conductors and shields are commonly made from high-atomic-number metallic elements, namely 47 for silver and 29 for copper, while dielectric insulators are typically combinations of low-atomic-number elements, namely 1 for hydrogen, 6 for carbon, 7 for nitrogen, 8 for oxygen, or 14 for silicon, the electron emission rates are much higher from the conductors and shields than from the dielectrics. Therefore, under ionizing radiation, there is a net flow of freed electrons from the conductors and shield to the insulator. The greater the difference in atomic number of the conductor & shield material from that of the insulator material, the greater the number of electrons available to be trapped at an interface between conductor material and insulator material and at an interface between shield material and insulator material.

In the prior art cable, the difference in electron emissions between the copper wire and its silver coating is inconsequential because they are both metals in direct electrical contact. The electrons flow freely back and forth between the two metals to maintain equal potentials. What impacts the SGEMP current pulse is the difference in emission rate from the metal surface versus the adjacent dielectric. In the prior art cable, that critical interface is between the silver coating on each of the conductor and shield wire, and the dielectric insulation. The very high electron emission rate of silver, relative to that of the dielectric, causes a large net flow of freed charges from the silver toward the dielectric in the prior art cable.

These emitted electrons are sufficiently energetic to jump across any gap that exists between the conductor and insulator, as well as between the shield and the insulator. The greater the gap size, the greater the range an electron travels to its trap-site in the insulator, and the greater the electromotive force exerted by that charge, on the other electrons in the shield and conductor, to drive the SGEMP current pulse.

A transient phenomenon occurs during radiation, known as "radiation-induced-dielectric-conductivity", where there is a certain degree of charge mobilization even within the dielectric. The degree of "conductivity" is material-dependent. Radiation-induced-dielectric-conductivity permits some of the displaced electrons to return to their emission source and recombine with the positive ions, thus curbing the SGEMP driver. However, gaps between the metal and the dielectric insulator eliminate many return paths for charge recombination. The gaps cause many of the electrons to be trapped far away from the metal source, thereby intensifying the electromotive force on other charges within the conductors and shield.

Since this quasi-conductive state in the insulator ends shortly after the radiation pulse, free electrons can travel only a short distance within the insulator before becoming trapped. Thus, the electron trap-sites are generally located close to the surface, that is within an electron range, of the insulator at each metal-insulator interface.

By convention, current in a normal circuit is considered to flow from a more positive point to a more negative point, even though the actual electron flow is in the opposite direction. Positive current flows from a signal source, namely conductors, to the ground, namely shield, while the electrons flow from the shield toward the conductors.

The prior art cable has gaps at both metal-insulator interfaces. The gap sizes at the shield-insulator interface are much larger than those at the conductor-insulator interface. Furthermore due to the shield braid wires having a greater electron emission surface area, the shield emits more electrons than the conductor wires, even though both shield and conductors are made of the same material. Thus, more electrons are trapped at the shield-interface, and trapped further from the shield, than their counterparts at the conductor-interface. Since the replacement electrons are drawn, from the conductors through intervening circuits, toward the shield, a negative SGEMP current pulse flows from the shield to the conductors in the prior art cable.

Each material layer in a cable, in the path of the radiation, attenuates the intensity and alters the energy spectrum of the radiation traveling through it. The degree to which one material shields those materials behind it, depends upon its material composition, that is its atomic number, density, thickness, coverage, and the wavelength of the radiation involved. Multiple conductors twisting around each other within a shielded cable would provide some degree of self-shielding which could limit electron emissions per conductor. Therefore, in the prior art cable, the SGEMP current pulse per conductor for a 3-conductor cable is less than that for a 2-conductor cable. Likewise for a 4-conductor cable the SGEMP current per conductor is less than that for a 3-conductor cable. However, the SGEMP current per conductor for a 2-conductor cable is not less than that for a single-conductor cable. This is because a shield that spans two twisted-insulated conductors inherently leaves larger gaps between the shield and the insulated conductors than a shield over a single-insulated conductor. On balance, gap sizes have a far greater impact on SGEMP current than X-ray or gamma-ray attenuation through self-shielding.

To summarize, X-rays and gamma-rays cause electrons to be displaced from the shield braid and from the conductors. Depending on the particular cable design, material geometry, gaps, radiation attenuation through materials, and the type of materials involved, more electrons are generally trapped at one interface than the other. This imperfect matching, of the forward-emitted shield wire electrons versus the reverse-emitted conductor core wire electrons, causes a charge imbalance. A resulting replacement current flows from the shield to the core wire, or from the core wire to the shield, through interconnected electronic packages. The polarity of this SGEMP current indicates the direction of current flow. Such transient negative or positive current, passing through electrical circuits, can damage sensitive electronic components inside the electronic box or equipment.

The smaller the charge imbalance in a given cable design, the smaller the SGEMP current pulse, and the lower the potential for damaging the interconnected electronics. A cable designed to have a very low SGEMP current pulse response to X-rays or gamma rays is considered to be "radiation-hardened". The prior art electrical cable has both high electron emissions and large gaps, that cause many electrons to be trapped at a distance. Together they generate the large electromotive force that induces a substantial SGEMP current to flow. Consequently, the prior art cable is not radiation-hardened.

A disclosed cable is a radiation-hardened electrical cable. The electrical cable achieves radiation-hardness by the insertion of low-Z trapped-electron reducers. The trapped-electron reducers reduce the emission of electrons between a high-Z metallic conductors and insulator, and the emission of electrons between a high-Z metallic shield and insulator when the cable is irradiated by high energy photons. The trapped-electron reducers minimize gaps which reduce the electron range to trap-sites and enhance charge recombination.

A disclosed cable can have a high-Z inner conductor, a first low-Z trapped-electron reducer around each inner high-Z conductor, a dielectric insulator layer around that first trapped-electron reducer, a second low-Z trapped-electron reducer around a twisted-bundle of insulated-conductors (or around each insulated conductor), and a high-Z outer shield around the second trapped-electron reducer(s). A dielectric protective jacket can be placed around the outer shield.

The two trapped-electron reducers in the disclosed cable are a matched set, that is the reducers have identical dielectric and metals, to equally reduce electron emissions at both conductor-insulator interface and shield-insulator interface. Each trapped-electron reducer is made from a low-Z metal layer, such as an aluminum layer, that is joined to a low-Z dielectric film, such as a mylar or Kapton film. The aluminum layer can be an aluminum foil or aluminum film. The dielectric film is laminated to the aluminum layer as a dielectric backing, thus forming an essentially gapless-interface. The dielectric film can be made of identical dielectric material to the low-Z dielectric insulator.

More specifically, the disclosed cable can have one or more inner silver-coated copper central wire conductor(s). Each conductor may be a single silver-coated copper solid wire or a bundle of twisted-silver-coated-copper wire strands. A first trapped-electron reducer is around each inner silver-coated copper wire conductor, with the aluminum layer of the first trapped-electron reducer in direct electrical contact with the inner silver-coated copper wire conductor. A dielectric insulator is around each of the first trapped-electron reducers, with the insulator in contact with the dielectric backing of the trapped-electron reducer. A second trapped-electron reducer is around a twisted-bundle of insulated-conductors (or around each insulated-conductor), with the dielectric backing of the second trapped-electron reducer in contact with the dielectric insulator. A silver-coated copper braided shield can be around the second trapped-electron reducer, with the metallic shield in direct electrical contact with the aluminum layer of the second trapped-electron reducer. A protective dielectric jacket, can be placed around the metallic shield.

As mentioned before, the difference in electron emissions between a copper wire conductors and its silver coating is inconsequential because they are both metals in direct electrical contact. The electrons flow freely back and forth between the two metals to maintain equal potentials. Likewise, the difference in electron emissions between the silver-coated wire and the aluminum film in the trapped-electron reducer is inconsequential because they are both metals, also in direct electrical contact and at equal potential.

Again, what impacts the SGEMP current pulse is the difference in electron emission rates of the metal versus the dielectric at their mutual interface. For the disclosed cable, that critical interface is, within each of the trapped-electron reducers, between the aluminum layer and its dielectric backing. Since the dielectric backing is laminated to the aluminum layer, the volume (number and size) of gaps at their mutual interface are orders of magnitude less than the gaps in the prior art cable.

Electrons emitted by the inner conductors and the outer shield will be electrically conducted back to the inner conductors and the outer shield from the aluminum layers of the trapped-electron reducers and not travel to electron traps in the dielectric layer.

Electron emissions from the dielectric film of each of the two trapped-electron reducers of the disclosed electrical cable will tend to equalize. This is the case since the material that makes up each of these two dielectric films is identical to each other. Further, said materials can be identical to material that makes up the dielectric insulator layer. Therefore there would be no net electron flow between each trapped-electron reducer's dielectric film and the dielectric insulator layer, so any gaps between them would have no impact on the SGEMP response in the disclosed cable.

Further, the inner conductors and outer shield of the disclosed cable will not send as great a number of free electrons toward the dielectric backing and insulator layer, due to protection against X-rays or gamma rays afforded by the aluminum layer of each of the trapped-electron reducers of the disclosed cable. Without such protection, the inner conductors and outer shield would send many more free electrons toward the dielectric backing and insulator layer.

The aluminum layer of each of the trapped-electron reducers, the protected inner conductors and the protected outer shield, all taken together, will not send as many free electrons toward traps in the dielectric insulator, as compared to unprotected inner conductors and outer shield of a prior art cable.

A table below shows the relative electron emission rates for disclosed cable materials when the materials are irradiated by high energy photons having energies ranging from 20,000 to 40,000 electron-volts. The electron emission rates produced in response to these high energy photons have been normalized to the aluminum emission rate. In other words, the emission rate of each element is indicated as a multiple or faction of aluminum emission rate. Such high energy photons, typical in nuclear explosions, produce a smaller SGEMP current pulse in the disclosed cable than in a prior art cable.

The electron emission rate of aluminum, aluminum having an atomic number, namely Z, equal to 13, is an order of magnitude less than that of silver, wherein Z equals 47. The average Z of the dielectric material, such as mylar or Kapton, used for the dielectric insulator layer and dielectric film of the disclosed cable, is less than 6. The emission rate of aluminum is much closer to the emission rate of the dielectric material in the disclosed cable. The smaller the difference in electron emission rates at the critical interface between the metal and its adjacent dielectric, the fewer electrons would be displaced under radiation. There is an order of magnitude reduction in electron displacements at the critical interface in the disclosed cable, that is aluminum-to-dielectric interface, versus the prior art cable that has a silver-to-dielectric interface. Less electrons displaced means less electrons available to be trapped.

TABLE

| Element | Atomic Number (Z) | Relative Electron Emission from 20 to 40 keV Photons |
|---|---|---|
| (I) Typical metal material of conductors and shield | | |
| Silver (Ag) | 47 | 11 |
| Copper (Cu) | 29 | 9 |
| (II) Metal material of the layer of trapped-electron reducer | | |
| Aluminum (Al) | 1 3 | 1 |
| (III) Typical dielectric materials of insulator layer and film of trapped-electron reducer | | |
| Mylar (H,C,O) | 1,6,8 (average less than 6) | 0.1 |
| Kapton (H,C,N,O) | 1,6,7,8 (average less than 6) | 0.08 |

Given a prior art cable where the shield and the conductors are made of the same material, the braided shield, having a geometrically larger electron emission surface area, would emit more electrons than would the conductors. In the prior art cable, this geometric imbalance contributes to the large negative-polarity SGEMP current pulse response.

In the disclosed cable, the trapped-electron reducers are low-electron emitters, essentially gap-free, and the emission surface areas of the shield-aluminum interface versus the conductor-aluminum interface are more balanced geometrically. This leads to a reduction in electron trap-sites and lower SGEMP response in the disclosed cable.

Since a smaller number of electrons will be stored in the dielectric layer of the disclosed cable, than in a prior art cable, there will be a smaller electromotive force (EMF) arising from the dielectric layer. A smaller SGEMP replacement current will be created in the inner conductors and outer shield. There will be a smaller SGEMP current pulse produced in the disclosed cable, as a result of inserting a gap free, low-Z metal-dielectric interface, such as an aluminum-dielectric layer, between the high-Z inner conductors and its primary insulation, and also inserting a second gap free, dielectric-low-Z metal interface between the primary insulation and the outer high-Z metal shield. Electrical equipment connected to a cable with high-Z conductors and shield protected with trapped-electron reducers will not be harmed. Again a smaller Systems-Generated-Electromagnetic Pulse will be produced in the disclosed cable, than in the prior art cable.

A disclosed cable having multiple inner conductors can have two alternate constructions. Both constructions begin with a first trapped-electron reducer around each inner conductor. (A conductor can be a single silver-coated copper solid wire or a bundle of twisted silver-coated copper wire strands.) The aluminum layer of each inner trapped-electron reducer is in electrical contact with each inner conductors. A dielectric insulator layer is around each of the inner trapped-electron reducers.

Construction 1 has one outer trapped-electron reducer around the twisted-pair of dielectric-insulated-conductors. The dielectric film of that outer trapped-electron reducer is in contact with the dielectric insulator layer of both insulated-conductors. A metallic shield is around this outer trapped-electron reducer. A protective nonconductive jacket is around the metallic shield.

Construction 2 has an outer trapped-electron reducer around each individual dielectric-insulated-conductor. The dielectric film of each outer trapped-electron reducer is in contact with the dielectric insulator layer of each insulated-conductor. A metallic shield is around both outer trapped-electron reducers. A protective nonconductive jacket is around the metallic shield.

Construction 1 will have a smaller diameter than construction 2 because it uses one outer trapped-electron reducer for all the insulated-conductors rather than one outer trapped-electron reducer for each insulated-conductor. In the application of twisted two-conductor cables, representing signal and return lines, construction 1 is more effective in minimizing crosstalk in cable bundles.

SUMMARY OF THE INVENTION

A radiation-hardened electrical cable comprising a high-Z conductor, a first trapped-electron reducer having a low-Z metal layer and a low-Z dielectric film, the low-Z metal layer of the first trapped-electron reducer being against the high-Z conductor, a low-Z dielectric insulator against the first trapped-electron reducer; a second trapped-electron reducer having a low-Z metal layer and a low-Z dielectric film, the low-Z dielectric film of the second trapped-electron reducer being against the low-Z dielectric insulator, and a high-Z conductive shield against the second trapped-electron reducer.

DESCRIPTION OF THE PREFERRED EMBODIMENT

Figure 3:
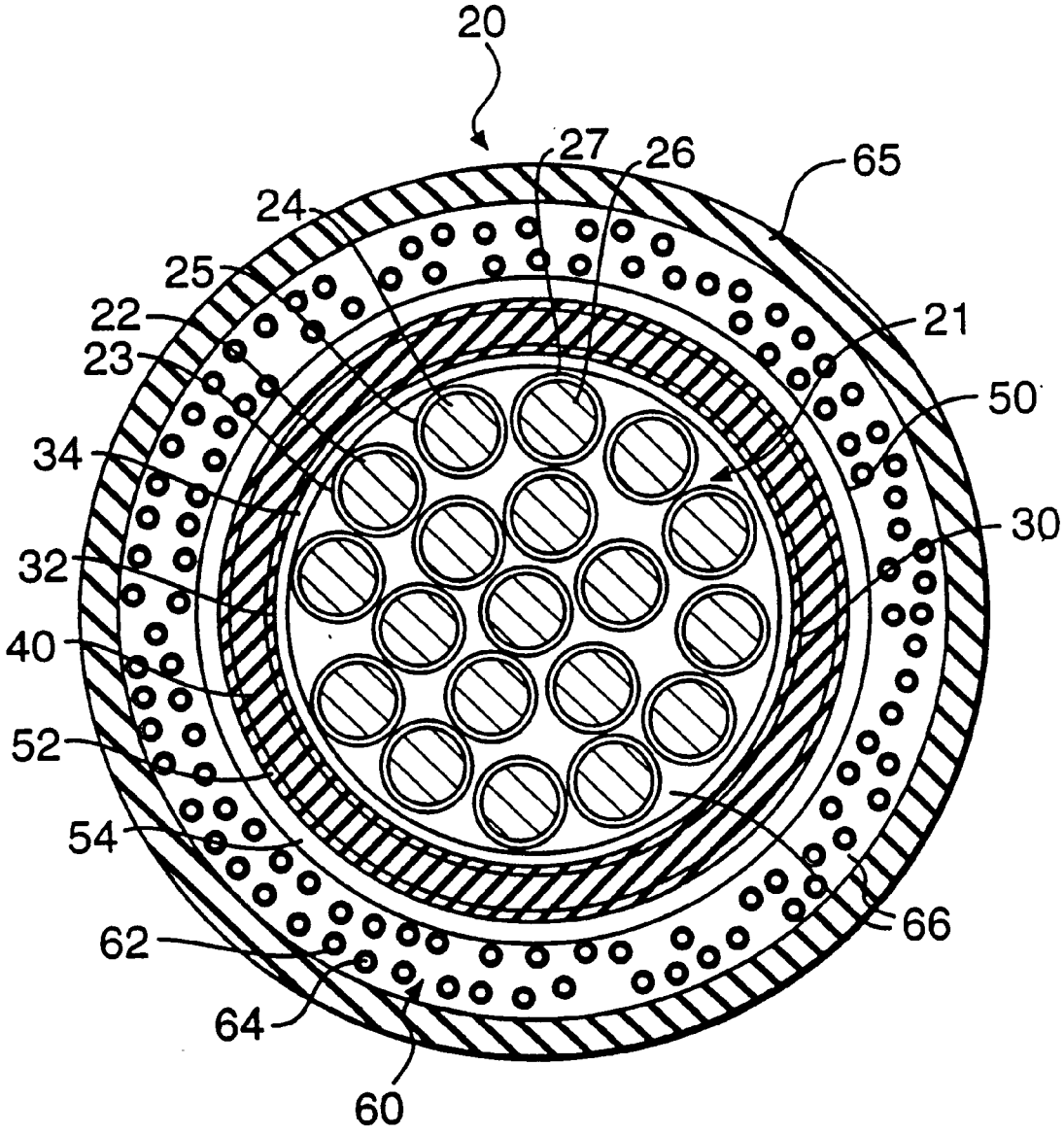
FIG. 3 is a cross sectional view of a disclosed one-conductor radiation-hardened cable.

FIG. 3 shows a radiation-hardened electrical cable 20. The cable 20 has conductor 21 consisting of 19 silver-coated copper wire strands. (However the conductor 21 could be uncoated copper wire strands.) Each wire strand is cylindrical in shape. Of the many silver-coated copper wire strands, a copper wire strand 22 has a silver coating 23, a copper wire strand 24 has a silver coating 25, and a copper wire strand 26 has a silver coating 27. A single large cylindrical conductor could replace the set of smaller cylindrical wire strands of conductor 21. The set of wire strands is preferably cylindrical, but set could be square, elliptical or another geometric shape. The set of wire strands of conductor 21 acts as a single conductor.

The set of silver-coated copper wire strands can be made by taking copper wire and electroplating the copper wire with silver. The silver-coated wire is cut into conductors, including strands 22, 24, and 26. Strands, such as strands 22, 24, and 26, are joined in a parallel arrangement and twisted to form conductor 21 of cable 20.

A first trapped-electron reducer 30 is shown around conductor 21. The first trapped-electron reducer 30 comprises a low-Z dielectric film 32, such as a mylar or Kapton film, onto which a low-Z aluminum layer 34 is placed, such as by lamination pressure of an aluminum foil onto dielectric film 32, or by other means such as electrode-less plating of aluminum onto dielectric film 32. The aluminum layer 34 of the first trapped-electron reducer 30 is placed in electrical contact with conductor 21.

The first trapped-electron reducer 30 is wrapped completely around conductor 21, with the aluminum layer 34 in electrical contact with conductor 21. Longitudinal edges of trapped-electron reducer 30 overlap slightly.

A low-Z dielectric insulator 40, such as Kapton, is wrapped around dielectric film 32. The dielectric insulator can be made of any low-Z cable dielectric insulator material that satisfies the requirements of a given application. The dielectric insulator 40 is placed in tight contact with the dielectric film 32 of trapped-electron reducer 30.

The aluminum layer 34 of the first trapped-electron reducer 30 will reflect a significant portion of free electrons that are emitted by the central conductors. The aluminum layer 34 keeps a significant portion of these electrons away from dielectric film 32 and dielectric insulator layer 40.

Conductor 21 will not transmit a large quantity of free electrons into dielectric film 32 and dielectric layer 40, due to the protection of the aluminum layer 34. Without such protection, conductor 21 would transmit many free electrons.

The aluminum layer 34 will not produce free electrons in as great a quantity as silver or copper. When bombarded by 20 to 40 kilovolts X-ray photons, aluminum atoms produce eleven times less electrons than silver atoms. Thus, there will be no significant spread of free electrons from conductor 21 and aluminum layer 34, to dielectric film 32 and dielectric insulator layer 40. Thus, there will not be a significant number of such free electrons trapped in the dielectric film 32 and the dielectric insulator layer 40.

A second trapped-electron reducer 50 is wrapped around the dielectric 40. The second trapped-electron reducer 50 is made in an identical manner as is the first trapped-electron reducer 30. The second trapped-electron reducer 50 is wrapped around the dielectric insulator layer 40, with the dielectric film 52 in contact with the dielectric insulator layer 40.

FIG. 3 shows that cable 20 has a metallic braided shield 60, made by weaving silver-coated copper wires. One such copper wire is copper wire 64 with silver coating 62. However uncoated copper wires could be used for metallic shield 60. The shield 60 is braided over the second trapped-electron reducer 50, with the silver-coated copper shield 60 in electrical contact with the aluminum layer 54.

FIG. 3 shows a cable 20 having a protective polymer dielectric jacket 65 wrapped around the silver-coated copper shield 60. However such a protective jacket is not a necessary part of the cable 20.

Figure 4:
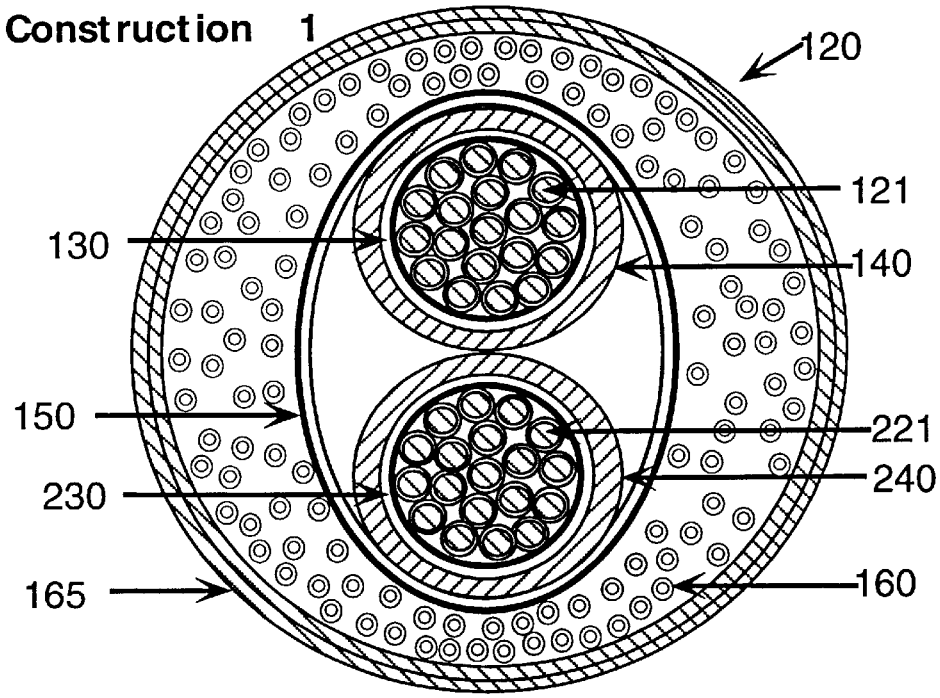
FIGS. 4 and 5 are cross-sectional views of two versions of a disclosed two-conductor radiation-hardened cable.
Figure 5:
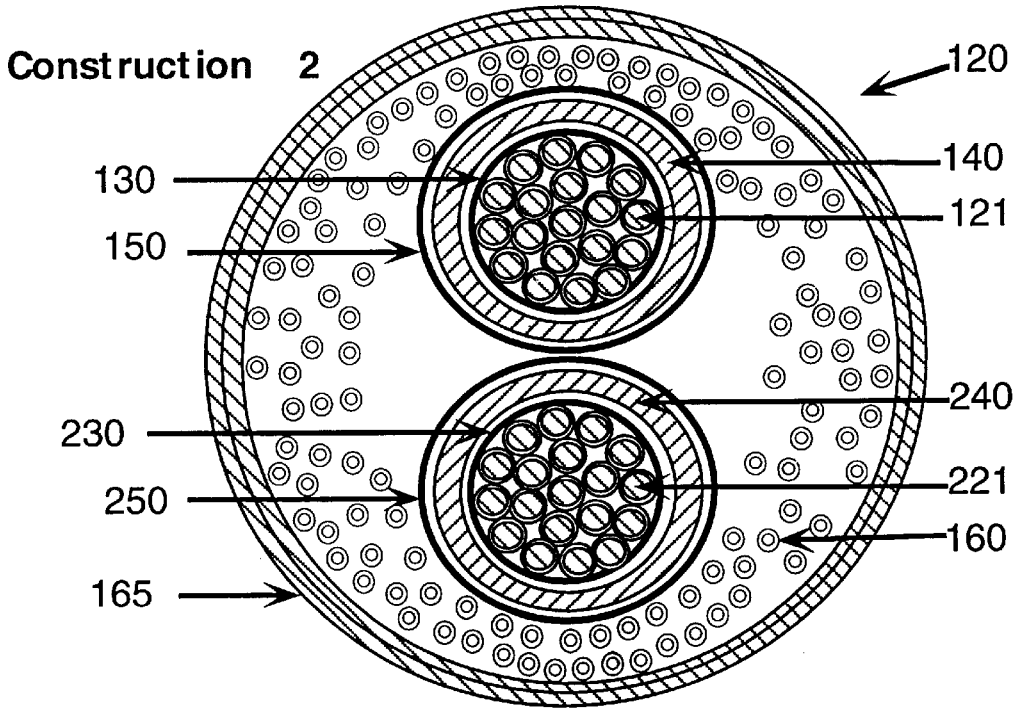

FIGS. 4 & 5 show a radiation-hardened two-conductor cable 120 that may be constructed in two ways. Both construction methods have components, namely silver-coated copper conductors 121 and 221, inner low-Z trapped-electron reducers 130 and 230, low-Z dielectric insulators layers 140 and 240, silver-coated copper shield 160, and protective jacket 165. But construction 1 has only one outer trapped-electron reducer 150 while construction 2 has two outer trapped-electron reducers 150 and 250, one for each insulated conductor. These components of cable 120 are equal to above described corresponding components of cable 20.

The trapped-electron reducer concept can be applied to any high-Z solid shield and/or high-Z solid conductor cable. Again Z is the atomic number of the elements in the metal material and in the dielectric material used in the cables shown in FIGS. 3 to 8 inclusive. A high-Z value is a Z of 21 or greater. A low-Z value is a Z of less than 21.

In FIG. 3, gaps and spaces 66, between the set of conductor wire strands conductor 21 and the first aluminum layer 34, and between the wire strands of shield 60 and the aluminum layer 54 have no impact on electrons traps in the disclosed cable. Since the critical interfaces for the disclosed cable are between the aluminum films 34 and 54 and their dielectric backings 32 and 52, which are essentially gapless, the return paths for charge recombination are unhindered.

Thus, there will not be a significant induced SGEMP current pulse produced between a conductor 21 and shield 60, due to a build up of free electrons in traps in the dielectric films 32 and 52, and dielectric insulator layer 40, as a result of placing the aluminum layer 34 around and in electrical contact with the conductor 21, plus the aluminum layer 54 inside of and in electrical contact with the shield 60. Electrical equipment connected to cable 20 will not be harmed by transcient radiation.

When the cable 20 is exposed to X-rays or gamma-rays, silver layers of conductor 21, such as 23, 25, and 27 on strands 22, 24, and 26, respectively, and silver layers, such as 62, of shield 64 will emit free electrons, but these electrons are reflected back since the dielectric films 32 and 52 and the dielectric insulator layer 40 are protected by aluminum layer 34 and aluminum layer 54.

Few free electrons are emitted by the aluminum layer 34 and aluminum layer 54. Fewer electrons will be trapped in the dielectric films 32 and 52 and in the dielectric insulator 40.

The reduced transmission of free electrons and the lack of trapping of free electrons in the dielectric films 32 and 52 and insulator layer 40 tend to prevent a SGEMP current pulse from being induced between the shield and the conductor.

Figure 6:
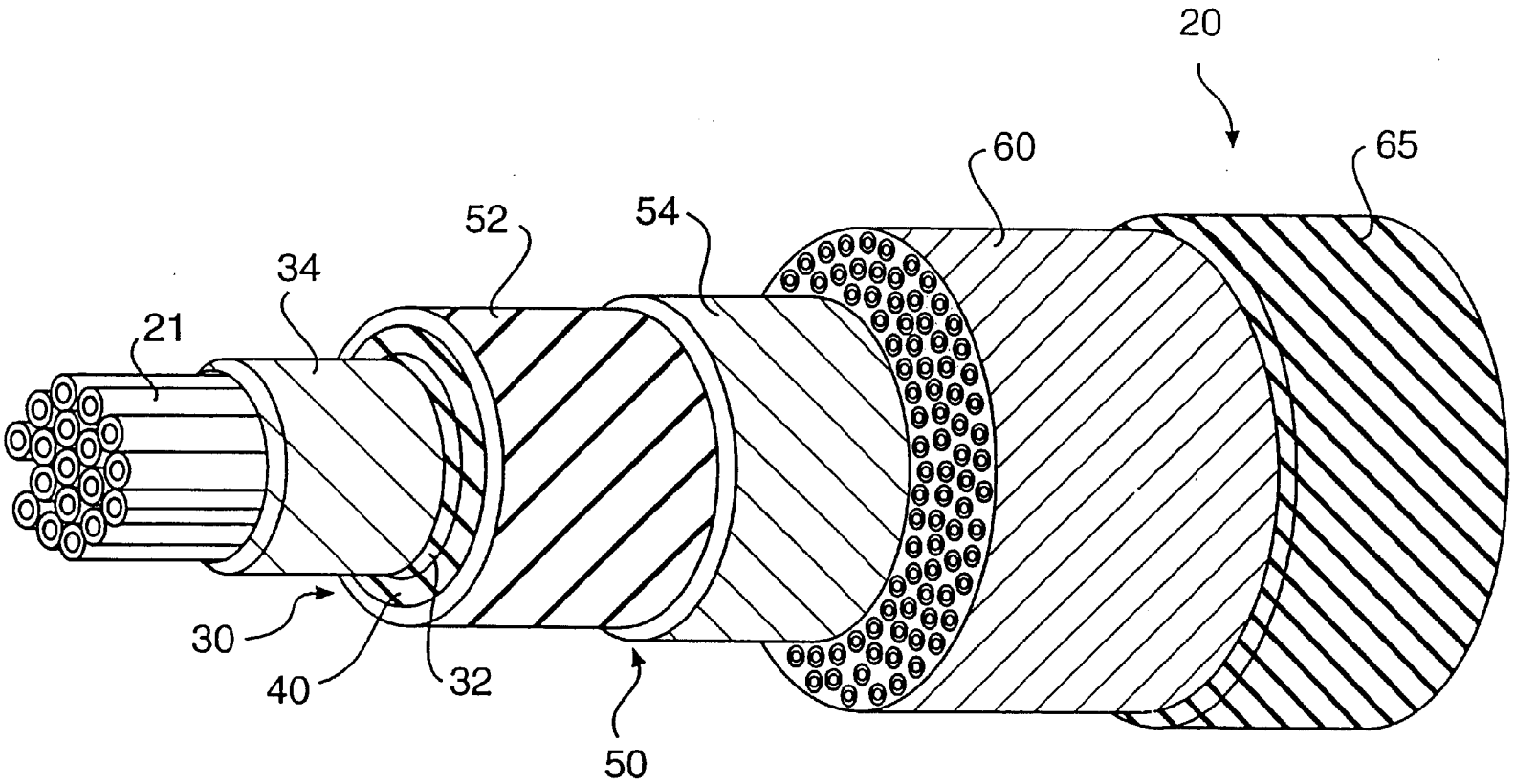
FIG. 6 is a 3-dimensional view of FIG. 3.

FIG. 6 is a 3-dimensional view of the cable 20 of FIG. 3. In FIG. 6 cable 20 uses tape-wrapping and shield-braiding processes for cable manufacturing. The cable 20 can be implemented in an extrusion process with a solid central conductor, and/or a solid shield. The shield, conductor, and dielectric can be made by any combination of materials and processes determined by application. The trapped-electron reducer concept can be applied on cables with any number of conductors. Multi-conductor versions can be fabricated like the two-conductor models shown in FIGS. 4 & 5 and 7–8, using a single outer trapped-electron reducer around all the insulated conductors as in construction 1 or a separate outer trapped-electron reducer for each insulated conductor as in construction 2, or combination of constructions 1 and 2. The only requirement is that the trapped-electron reducers be a low-atomic number conductive material inserted at the interface with each conductor and the interface with the shield 60.

Figure 7:
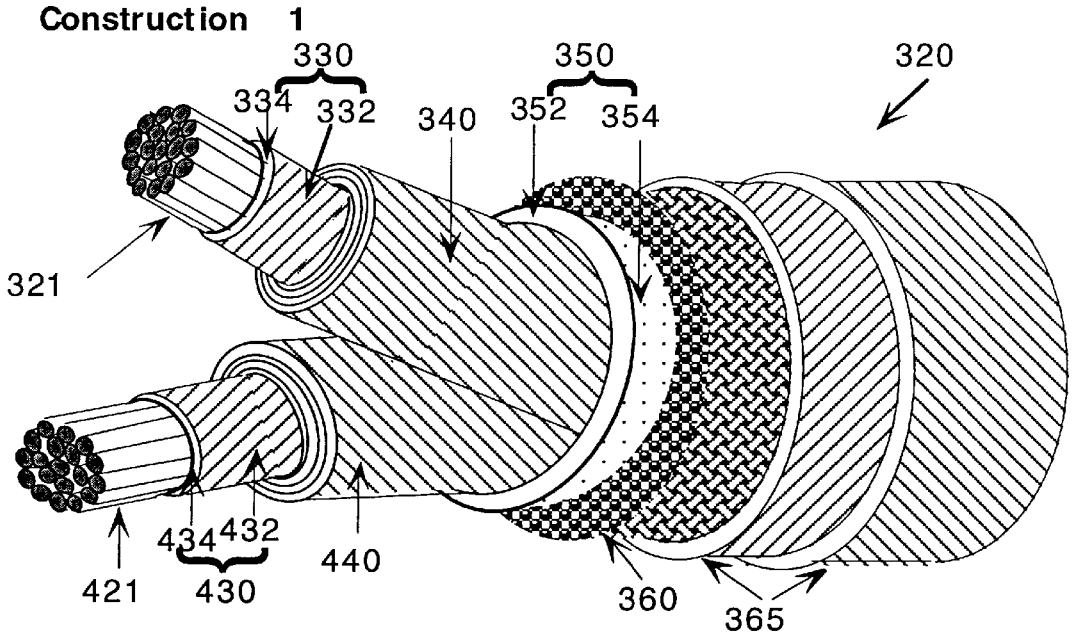
FIGS. 7 and 8 are 3-dimensional views of FIG. 4.
Figure 8:
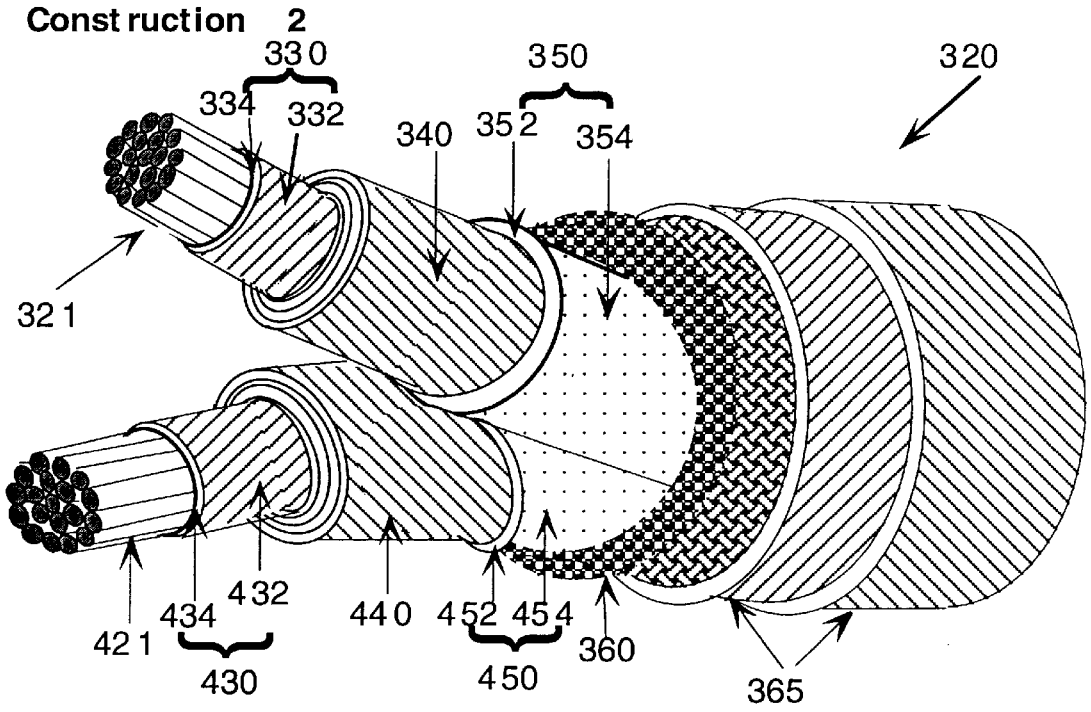

FIGS. 7 and 8 show 3-dimensional views of the two versions of radiation-hardened two-conductor cable 320 of FIGS. 4 and 5. Both constructions have two inner conductors 321 and 421. An aluminum layer 334 of inner trapped-electron reducer 330 is in electrical contact with inner conductor 321. An aluminum layer 434 of inner trapped-electron reducer 430 is in electrical contact with conductor 421. A dielectric insulator layer 340 is around trapped-electron reducer 330. A dielectric layer 440 is around trapped-electron reducer 430. A dielectric film 332 and 432 of each of the inner trapped-electron reducers 330 and 430, respectively, is in contact with dielectric insulators 340 and 440.

Figure 1:
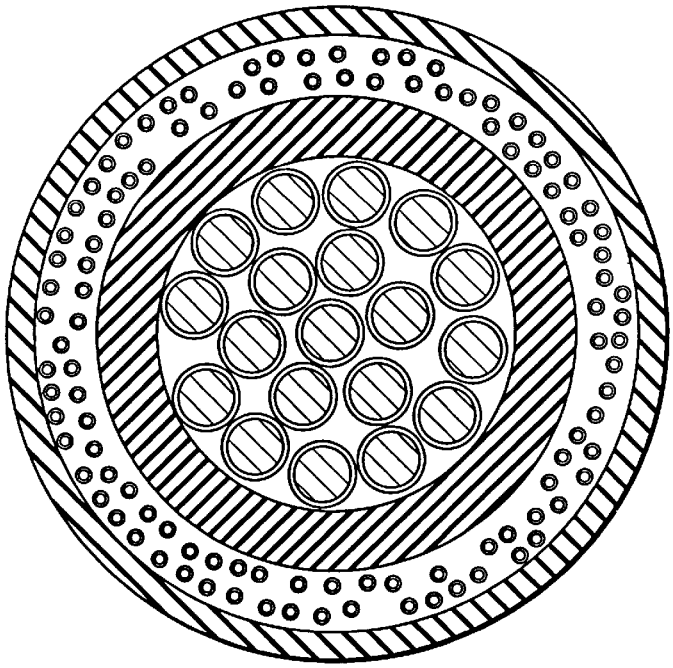
FIG. 1 PRIOR ART
FIG. 1 is a cross sectional view of a prior art cable.
Figure 2:
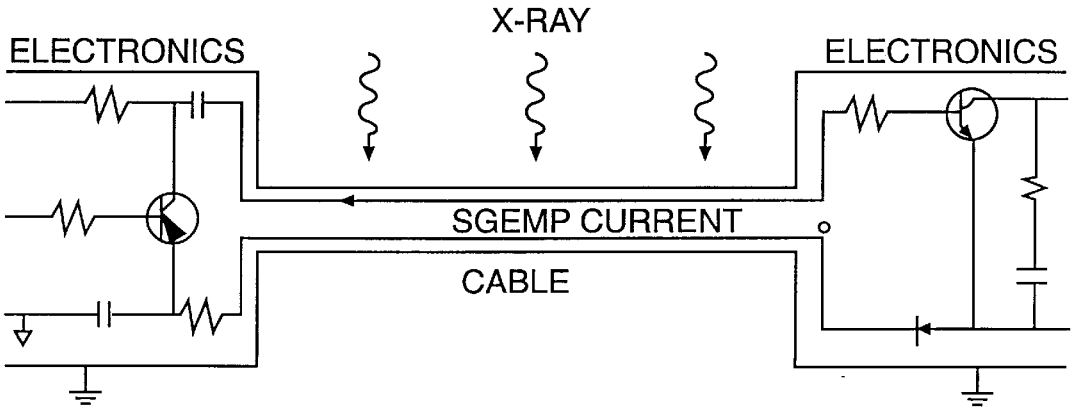
FIG. 2 PRIOR ART
FIG. 2 is a schematic view of a circuit connected to a cable during radiation.

The difference between FIGS. 4 and 7 and FIG. 8 is in the number of outer trapped-electron reducers. In FIG. 7, a single outer trapped-electron reducer 350 is around both insulated conductors. A dielectric film 352 of the outer trapped-electron reducer 350, is in contact with both dielectric insulators 340 and 440. An outer metallic shield 360 is around the outer trapped-electron reducer 350. The shield 360 is in electrical contact with the aluminum layer 354 of the outer trapped-electron reducer 350. In FIG. 2, an outer trapped-electron reducer is around each insulated conductor. A dielectric film 352 of outer trapped-electron reducer 350 is in contact with dielectric insulator 340. A dielectric film 452 of outer trapped-electron reducer 450 is in contact with dielectric insulator 440. A single outer metallic shield 360 is around both outer trapped-electron reducers 350 and 450. The shield 360 is in electrical contact with the aluminum layer 354 and 454 of the outer trapped-electron reducers 350 and 450, respectively. For both constructions, a protective nonconductive jacket 365 is around the metallic shield 360.

While the present invention has been disclosed in connection with the preferred embodiment thereof, it should be understood that there may be other embodiments which fall within the spirit and scope of the invention as defined by the following claims.

What is claimed is:

1. A radiation-hardened electrical cable, comprising:

(a) a high-Z conductor means;

(b) a first trapped-electron reducer having a low-Z metal layer and a low-Z dielectric film, the low-Z metal layer of the first trapped-electron reducer being inward of the low-Z dielectric film, the low-Z metal layer being against the high-Z conductor means, the first trapped-electron reducer surrounding the high-Z conductor means;

(c) a low-Z dielectric insulator against the low-Z dielectric film of the first trapped-electron reducer, the low-Z dielectric insulator surrounding the first trapped-electron reducer;

(d) a second trapped-electron reducer having a low-Z metal layer and a low-Z dielectric film, the low-Z dielectric film of the second trapped-electron reducer being against the low-Z dielectric insulator, the second trapped-electron reducer surrounding the low-Z dielectric insulator, the low-Z metal layer of the second trapped-electron reducer being outward of the low-Z dielectric film of the second trapped electron reducer; and (e) a high-Z conductive shield surrounding the metal layer of the second trapped-electron reducer, the high-Z conductive shield being in electrical contact with the metal layer of the second trapped-electron reducer.

2. The radiation-hardened electrical cable of claim 1, wherein the high-Z conductor means is a twisted-bundle of high-Z wires and wherein the high-Z shield is braided high-Z wires.

3. The radiation-hardened electrical cable of claim 1, wherein the high-Z conductor means is a single solid high-Z wire, and wherein the high-Z shield is braided high-Z wires.

4. The radiation-hardened electrical cable of claim 1, wherein the high-Z conductor means is a twisted-bundle of high-Z wires, and wherein the high-Z shield is a high-Z solid shield.

5. The radiation-hardened electrical cable of claim 1, wherein the high-Z conductor means is a single solid high-Z wire, and wherein the high-Z shield is a high-Z solid shield.

6. A radiation-hardened electrical cable, comprising:

(a) a high-Z conductor;

(b) a first trapped-electron reducer surrounding the high-Z conductor, the first trapped-electron reducer being an aluminum layer on a low-Z dielectric film, the aluminum layer of the first trapped-electron reducer being inward of the low-Z dielectric film, the aluminum layer being in electrical contact with the high-Z conductor;

(c) a low-Z dielectric insulator surrounding the first trapped-electron reducer, the low-Z dielectric insulator being against the low-Z dielectric film of the first trapped-electron reducer;

(d) a second trapped-electron reducer surrounding the dielectric insulator, the second trapped-electron reducer being an aluminum layer on a low-Z dielectric film, the dielectric film of the second trapped-electron reducer being in contact with the low-Z dielectric insulator, the aluminum layer of the second trapped-electron reducer being outward of the low-Z dielectric film of the second trapped electron reducer; and (e) a high-Z shield surrounding the aluminum layer of the second trapped-electron reducer, the high-Z shield being in electrical contact with the aluminum layer of the second trapped-electron reducer.

7. The radiation-hardened electrical cable of claim 6, wherein the high-Z conductor is a twisted-bundle of high-Z wires, and wherein the high-Z shields is braided high-Z wires.

8. The radiation-hardened electrical cable of claim 6, wherein the high-Z conductor is a single solid high-Z wire, and wherein the high-Z shield is braided high-Z wires.

9. The radiation-hardened electrical cable of claim 6, wherein the high-Z conductor is a twisted-bundle of high-Z wires, and wherein the high-Z shield is a high-Z solid shield.

10. The radiation-hardened electrical cable of claim 6, wherein the high-Z conductor is a single solid high-Z wire, and wherein the high-Z shield is a high-Z solid shield.

11. A radiation-hardened electrical cable, comprising:

(a) a first high-Z conductor;

(b) a first trapped-electron reducer surrounding the high-Z conductor, the first trapped-electron reducer being an aluminum layer on a low-Z dielectric film, the aluminum layer of the first trapped-electron reducer being inward of the low-Z dielectric film, the aluminum layer being in electrical contact with the first high-Z conductor;

(c) a first low-Z dielectric insulator surrounding the first trapped-electron reducer, the first low-Z dielectric insulator being against the low-Z dielectric film of the first trapped-electron reducer;

(d) a second high-Z conductor;

(e) a second trapped-electron reducer surrounding the second high-Z conductor, the second trapped-electron reducer being an aluminum layer on a low-Z dielectric film, the aluminum layer of the second trapped-electron reducer being inward of the low-Z dielectric film, the aluminum layer being in electrical contact with the second high-Z conductor;

(f) a second low-Z dielectric insulator surrounding the second trapped-electron reducer, the second low-Z dielectric insulator being against the low-Z dielectric film of the second trapped-electron reducer;

(g) a third trapped-electron reducer encircling both first and second low-Z dielectric insulators, the third trapped-electron reducer being an aluminum layer on a low-Z dielectric film, the dielectric film of the third trapped-electron reducer being in contact with both said first and second low-Z dielectric insulators, the aluminum layer of the third trapped-electron reducer being outward of the low-Z dielectric film of the third trapped electron reducer; and (h) a high-Z shield surrounding the aluminum layer of the third trapped-electron reducer, the high-Z shield being in electrical contact with the aluminum layer of the third trapped-electron reducer.

12. The radiation-hardened electrical cable of claim 11, wherein each of the first high-Z conductor and second high-Z conductor is a twisted-bundle of high-Z wires, and wherein the high-Z shield is braided high-Z wires.

13. The radiation-hardened electrical cable of claim 11, wherein each of the first high-Z conductor and second high-Z conductor is a single solid high-Z wire, and wherein the high-Z shield is braided high-Z wires.

14. The radiation-hardened electrical cable of claim 11, wherein each of the first high-Z conductor and second high-Z conductor is a twisted-bundle of high-Z wires, and wherein the high-Z shield is a high-Z solid shield.

15. The radiation-hardened electrical cable of claim 11, wherein each of the first high-Z conductor and second high-Z conductor is a single solid high-Z wire, and wherein the high-Z shield is a high-Z solid shield.

16. A radiation-hardened electrical cable, comprising:

(a) a first high-Z conductor;

(b) a first trapped-electron reducer surrounding the first high-Z conductor, the first trapped-electron reducer being an aluminum layer on a low-Z dielectric film, the aluminum layer of the first trapped-electron reducer being inward of the low-Z dielectric film, the aluminum layer being in electrical contact with the first high-Z conductor;

(c) a first low-Z dielectric insulator surrounding the first trapped-electron reducer, the first low-Z dielectric insulator being against the low-Z dielectric film of the first trapped-electron reducer;

(d) a second trapped-electron reducer surrounding the first low-Z dielectric insulator, the second trapped-electron reducer being an aluminum layer on a low-Z dielectric film, the low-Z dielectric film of the second trapped-electron reducer being in contact with the low-Z dielectric insulator, the aluminum layer of the second trapped-electron reducer being outward of the low-Z dielectric film of the second trapped electron reducer;

(e) a second high-Z conductor;

(f) a third trapped-electron reducer surrounding the second high-Z conductor, the third trapped-electron reducer being an aluminum layer on a low-Z dielectric film, the aluminum layer of the third trapped-electron reducer being inward of the low-Z dielectric film, the aluminum layer being in electrical contact with the second high-Z conductor;

(g) a second low-Z dielectric insulator surrounding the third trapped-electron reducer, the second low-Z dielectric insulator being against the low-Z dielectric film of the third trapped-electron reducer;

(h) a fourth trapped-electron reducer surrounding the second low-Z dielectric insulator, the fourth trapped-electron reducer being an aluminum layer on a low-Z dielectric film, the dielectric film of the fourth trapped-electron reducer being in contact with the second low-Z dielectric insulator, the aluminum layer of the fourth trapped-electron reducer being outward of the low-Z dielectric film of the fourth trapped electron reducer; and (i) a high-Z shield surrounding both the second trapped-electron reducer and the fourth trapped-electron reducer, the high-Z shield being in electrical contact with both the aluminum layer of the second trapped-electron reducer and the aluminum layer of the fourth trapped-electron reducer.

17. The radiation-hardened electrical cable of claim 16, wherein each of the first high-Z conductor and second high-Z conductor is a twisted-bundle of high-Z wires, and wherein the high-Z shield is braided high-Z wires.

18. The radiation-hardened electrical cable of claim 16, wherein each of the first high-Z conductor and second high-Z conductor is a single solid high-Z wire and wherein the high-Z shield is braided high-Z wires.

19. The radiation-hardened electrical cable of claim 16, wherein each of the first high-Z conductor and second high-Z conductor is a twisted-bundle of high-Z wires, and wherein the high-Z shield is a high-Z solid shield.

20. The radiation-hardened electrical cable of claim 16, wherein each of the first high-Z conductor and second high-Z conductor is a twisted-bundle of high-Z wires, and wherein the high-Z shield is braided high-Z wires.

* * * * *